United States Patent [19]

Kneezel et al.

[11] Patent Number: 5,043,740

[45] Date of Patent: Aug. 27, 1991

[54] USE OF SEQUENTIAL FIRING TO COMPENSATE FOR DROP MISPLACEMENT DUE TO CURVED PLATEN

[75] Inventors: Gary A. Kneezel, Webster; Stephen F. Pond, Pittsford, both of N.Y.

[73] Assignee: Xerox Corporation, Stamford, Conn.

[21] Appl. No.: 450,421

[22] Filed: Dec. 14, 1989

[51] Int. Cl.[5] ..... B41J 2/07; B41J 2/045

[52] U.S. Cl. ..... 346/1.1; 346/140 R; 346/75

[58] Field of Search ..... 346/1.1, 75, 140

[56] References Cited

U.S. PATENT DOCUMENTS

| | | | |
|---|---|---|---|
| 4,158,204 | 6/1979 | Kuhn et al. | 346/75 |
| 4,167,014 | 9/1979 | Darling et al. | 346/75 |
| 4,231,048 | 10/1980 | Horike et al. | 346/140 R |
| 4,524,364 | 6/1985 | Bain et al. | 346/1.1 |
| 4,535,339 | 8/1985 | Horike et al. | 346/75 |
| 4,540,990 | 9/1985 | Crean | 346/75 |
| 4,626,867 | 12/1986 | Furukawa et al. | 346/1.1 |
| 4,670,761 | 6/1987 | Yoshino et al. | 346/75 |
| 4,709,244 | 11/1987 | Platt et al. | 346/140 R |

OTHER PUBLICATIONS

R. F. Pan, Print Quality Improvement in Multiple Nozzle Ink Jet Printers; 12-80; pp. 1 and 2, vol. 23 No. 7B IBM Technical Disclosure Bulletin.

*Primary Examiner*—Benjamin R. Fuller
*Assistant Examiner*—Victor DeVito
*Attorney, Agent, or Firm*—Oliff & Berridge

[57] ABSTRACT

A method and apparatus actuates a line of printing elements to form characters on a recording medium contained on a curved surface of a platen. The printing elements are sequentially actuated, starting with nozzles located furthest from the platen and proceeding towards printing elements located closest to the platen until the actuation of all element has been performed. The line of printing elements can form a printhead which includes a plurality of nozzles arranged in at least one line having opposing ends, this line being substantially perpendicular to a longitudinal axis of the curved platen. Preferably, the line of nozzles is arranged with its center located closest to the platen and the nozzles are actuated starting at the ends of the line of nozzles.

16 Claims, 3 Drawing Sheets

USE OF SEQUENTIAL FIRING TO COMPENSATE FOR DROP MISPLACEMENT DUE TO CURVED PLATEN

BACKGROUND OF THE INVENTION

1. Field of the Invention

The present invention relates to methods and apparatus for printing which compensate for a variable distance between a printhead and a recording medium.

2. Description of the Related Art

A standard printer architecture for low volume products employs a printhead on a moving carriage, printing on paper which conforms to a cylindrical platen or roller. A certain class of these printers, such as some thermal ink jet printers, use a printhead having a line of printing elements which is perpendicular to the axis of the curved platen. As a result, some of the printing elements are farther away from the paper than others. By positioning the printhead such that its central element is closest to the paper, the overall distance difference is minimized. FIG. 1 shows a side view of a printhead centered near a curved platen. At the center of the printhead the distance to the platen is D, but in general is $z=D+d$. If r is the radius of the platen and y is the distance above or below the printhead center, then $d=r(1-(1-(y^2/r^2))^{0.5})$. If y is much less than r, d is approximately $y^2/2r$.

Because the carriage is moving at velocity $v_c$ and the nozzles are not at uniform spacing from the paper, there will be a spot placement error in the x direction (the direction of movement of the carriage containing the printhead) such that $\Delta X_z=\Delta z(v_c/v_d)$ where $v_d$ is the drop velocity and $\Delta z$ is the difference in distance from the platen between the furthest nozzle and the closest nozzle. For a curved platen, where $\Delta z=d$ and d approximates ($\cong$) $y^2/2r$, $\Delta X_z$ is approximately $(y^2/2r)(v_c/v_d)$. Typical values are a carriage velocity $v_c$ of 0.25 m/sec and a drop velocity $v_d$ of 10 m/sec. For a printhead centered near a platen having a radius r of 0.8 inch, the spot placement from end jets would lag that of the center jets by 0.11 mil for a 1/6 inch printhead, but as much as 1.0 mil for a half inch printhead (assuming all jets were fired simultaneously).

Kuhn et al U.S. Pat. No. 4,158,204 discloses a system for neutralizing errors in printing caused by drop velocity variations from nozzle to nozzle by adjusting the timing sequence which controls the charging of the respective electrodes of each nozzle. Kuhn et al does not compensate for variations in the distance which drops from different nozzles must travel, but only compensates for variations in velocities of the drops expelled by different nozzles due to their differing nozzle characteristics. Kuhn et al does not recognize the problems addressed by the present invention.

Darling et al U.S. Pat. No. 4,167,014 discloses electronic lead determining circuitry that calculates the lead time for projection of ink drops at desired impact positions. The circuitry has detection elements and controlling elements for adjusting to a non-linear movement of the printhead carriage. Darling et al does not compensate for variable distances between different nozzles and the recording medium. Darling et al also does not teach or suggest actuating a column of nozzles sequentially from its ends toward its center.

Yoshino et al U.S. Pat. No. 4,670,761 discloses an ink jet recording apparatus that controls the trajectory of flying ink droplets to adjust to varying relative speed between a rotating drum and a plurality of printheads located adjacent the drum. Yoshino et al does not recognize the problems solved by the present invention and only compensates for variable drum rotation speed, not for drum curvature.

Horike et al U.S. Pat. No. 4,535,339 discloses a deflection control type ink jet recording apparatus in which the velocity of flying charged ink drops is detected and the ink pressure is controlled so as to make the ink velocity coincide with a predetermined target velocity. Horike et al does not teach or suggest the present invention.

Bain et al U.S. Pat. No. 4,524,364 discloses a circuit for use in an ink jet printer in which the carriage motion either approximates a sinusoidal vibratory pattern, or which has any variable velocity pattern that reliably repeats from cycle to cycle. Bain et al does not teach or suggest the present invention.

OBJECTS AND SUMMARY OF THE INVENTION

It is an object of the present invention to provide a method and apparatus for defect free printing on a curved platen using drop-on-demand printing processes.

It is another object of the present invention to provide a method and apparatus for compensating for drop misplacement on a curved platen while minimizing the peak current required to perform the printing.

The present invention involves methods and apparatus for sequentially actuating printing elements on a printhead in order to compensate for drop misplacement on a curved platen due to varying distances between the printing elements and the platen. Additionally, sequential firing of printing elements may be advantageous for printers such as thermal ink jet printers in order to minimize the peak current required. The basic formula for compensation is to (1) determine the distance the printing element furthest from the platen (usually an end element in a line of printing elements) will lag the printing element closest to the platen (preferably the center element in a line of printing elements) due to the curved platen for the printhead and printer conditions of interest; (2) determine the head start the furthest printing element will need in order to compensate for this error; and (3) divide up this time appropriately into pulse time intervals and starting the actuating at the furthest elements and working toward the closest elements. The pulse time intervals between the furthest printing elements and the closest printing elements can be the same or varied so that drop misplacement is minimized.

BRIEF DESCRIPTION OF THE DRAWINGS

The invention will be described in detail with reference to the following drawings in which like reference numerals refer to like elements and wherein.

DETAILED DESCRIPTION OF PREFERRED EMBODIMENTS

The present invention will be described in detail with reference to one specific application for thermal ink jet printheads. However, it is understood that the present invention can be applied to any type of printing where character formation is adversely affected by differences in distances between different printing elements of the printhead and the recording medium onto which printing is to occur.

Figure 1:
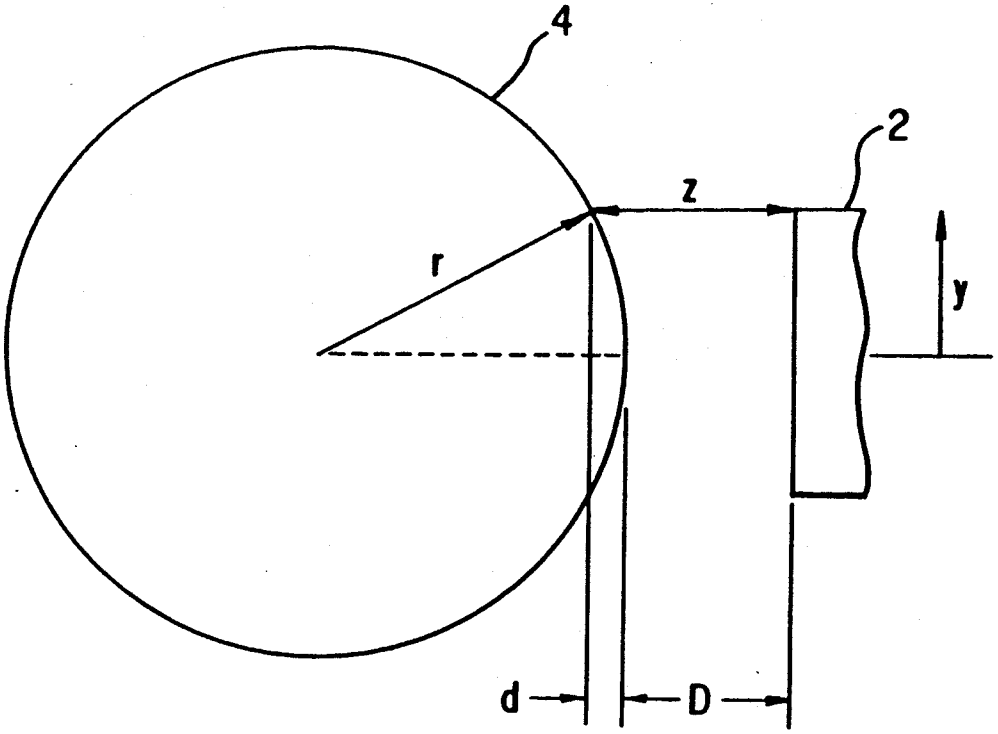
FIG. 1 is an enlarged cross-sectional view of a printhead arranged for printing on a curved platen and illustrates the difference in distance between printing elements located at different positions on a printhead from a curved platen.

FIG. 1 shows a cross-sectional view of a thermal ink jet printhead 2 arranged for printing onto a recording medium which is supported on a cylindrical platen 4. As discussed earlier, because the carriage containing the line of nozzles is moving at velocity $v_c$ and the nozzles are not uniformly spaced from the paper, there will be a spot placement error in the x direction such that $\Delta X_z=(y^2/2r)(v_c/v_d)$. The present invention makes use of sequential actuation of the nozzles in a line of nozzles to compensate for drop misplacement on a curved platen. The drop misplacement due to sequential actuation from a carriage moving at velocity $v_c$ is $\Delta X_t=v_c\Delta t$. The present invention makes use of the realization that the drop misplacement due to sequential actuation can be used to offset the drop misplacement due to the non-uniform spacing of individual nozzles from the platen to produce a thermal ink jet printer having improved drop placement.

The terms "actuation" and "addressing" are meant to describe the electrical impulse supplied to each nozzle in the line of nozzles for each position of the printhead as it scans across the recording medium. Thus, depending on the character being formed on the recording medium, different nozzles in the line of nozzles receive impulses of either zero (no drop formed) or some positive value (drop formed). However, regardless of which nozzles are actually supplied with a positive impulse (to expel a drop), the sequence for actuating all the nozzles proceeds from the nozzles located furthest from the platen to the nozzles located closest to the platen.

It is understood that any known type of circuitry can be used to control the actuation of the nozzles. The complexity of the electronic architecture of the printhead die may range from a very simple passive array (resistive heaters and leads only), to the use of driver transistors on the die (enabling matrix addressing of the heaters), to the incorporation of logic on the die. The benefit of these increasingly complex architectures is a dramatic reduction of the lead count. For example, a 144 jet passive array (with two common current leads) would have 146 leads, a matrix addressed array would have approximately 25 leads, and an array with on board logic would have about 10 leads. For the case of the passive array and the matrix addressed array, the sequence of jet firing is controlled entirely by circuitry or software external to the printhead die. In these cases, data to be printed is presented in the order of firing to external drivers connected to the printhead. For firing the end jets first and working toward the center, (rather than the more common fashion of starting at one end and working toward the other), the data would simply be sorted as such by the external software. Alternatively, the data could be fed into two shift registers operating in opposite directions for the two halves of the printhead. For the case of the printhead with integrated logic, the sequence of firing is partly determined by the data presented, but also by the structure of the integrated logic. For example, if the data is sequenced on the die via a shift register approach, it would be necessary to design the printhead die with two shift registers, one for each half of the printhead, which shifted in opposite directions. In this case, the requirement on the external organization of the data would simply be to present the data (e.g. using external software or shift registers operating in opposite directions) for the end jets on both sides first and the data for the center jets last.

The following examples illustrate a number of variations of the present invention.

EXAMPLE 1

Figure 2:
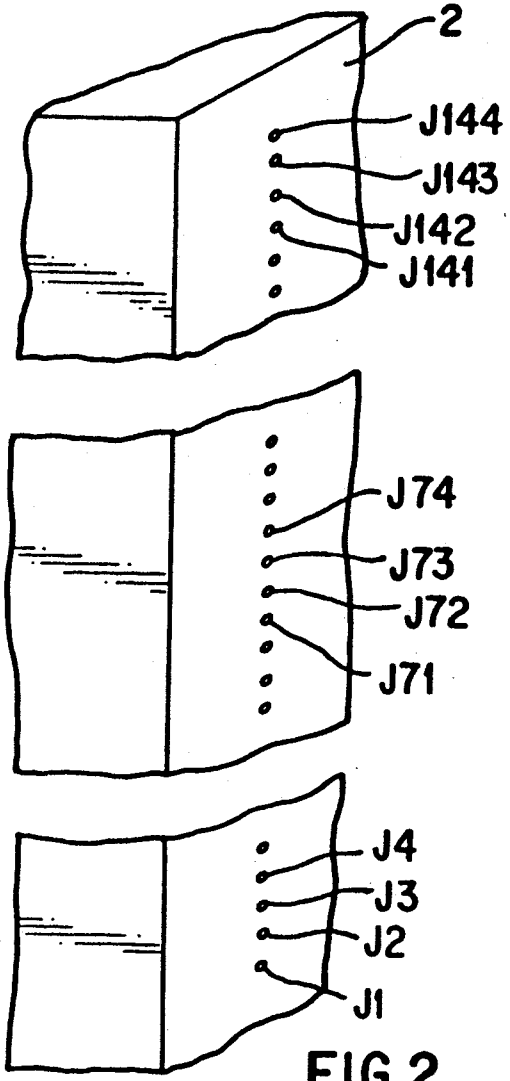
FIG. 2 is an isomeric view of a printhead arranged for thermal ink jet printing on a curved platen.
Figure 3A:
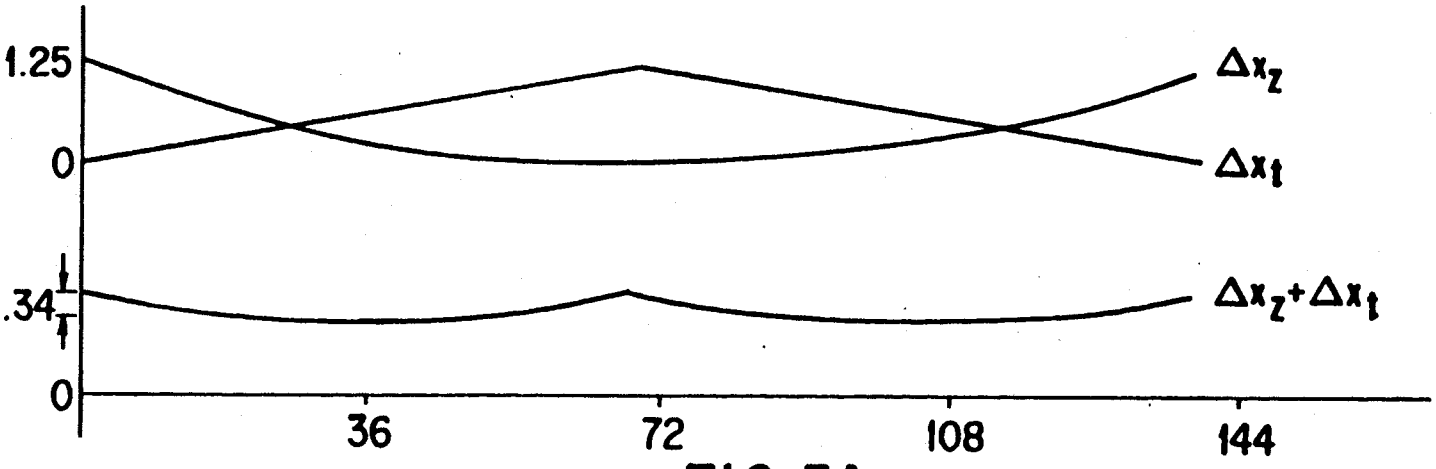
FIG. 3A is a graph illustrating drop placement versus nozzle position on the printhead achieved according to a first embodiment of the present invention.

Example 1 assumes a carriage velocity $v_c$ of ten inches per second (0.25 m/sec), a drop velocity $v_d$ of 8 m per second, a platen radius r of 0.796 inches, and a half inch printhead at 288 spi (nozzles per inch). If all 144 jets (FIG. 2) were shot at once, the misplacement of the end jets relative to the center jets would be 1.25 mil. For a carriage velocity of 10 inches per second, the misplacement could be compensated for by a 125 microsecond head start of the end jets. A pulse width of 3 microseconds is used to actuate each nozzle. Actuating all 144 jets within 125 microseconds may be accomplished by actuating 4 jets at a time (two jets from each end of the line of nozzles) with an interval between pulses of 3.5 microseconds. Jets J1, J2, J143 and J144 (FIG. 2) would be fired first, then, 3.5 microseconds later, jets J3, J4, J141 and J142 would be fired, and so on until jet J71, J72, J73 and J74 are fired. FIG. 3A shows the misplacement $X_z$ due to the curved platen, the compensating displacement $X_t$ due to sequential firing, as well as their sum. As can be seen in FIG. 3A, the total difference in spot placement is only 0.34 mil.

EXAMPLE 2

Figure 3B:
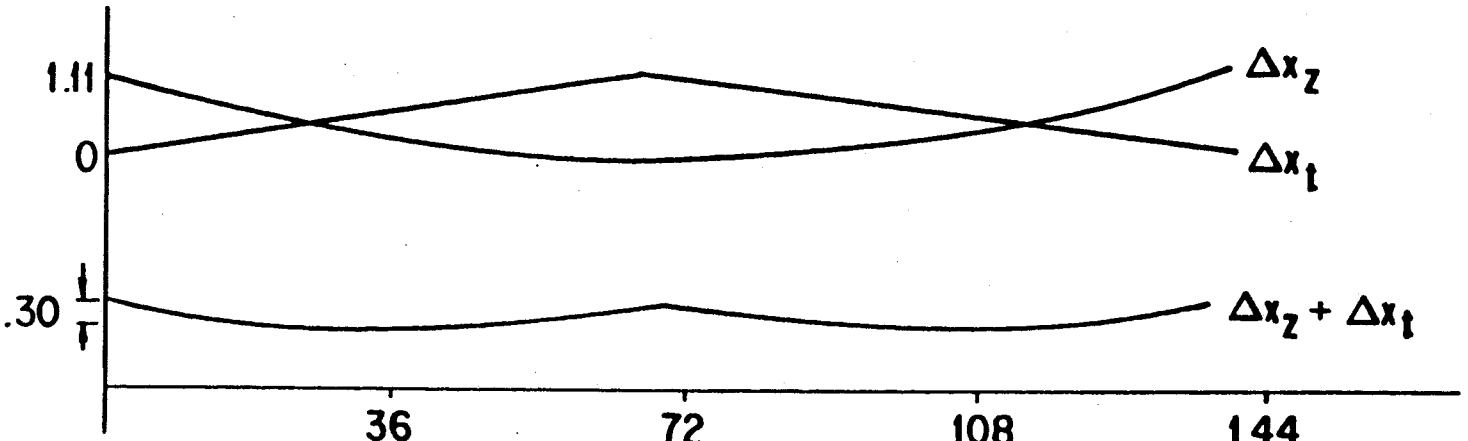
FIG. 3B is a graph illustrating spot placement versus nozzle position on the printhead achieved according to a second embodiment of the present invention.

Example 2 is similar to Example 1, but with a drop velocity $v_d$ of 9 m per second. In this case, the drop misplacement due to the curved platen if all 144 jets are actuated at once is 1.11 mils. However, as shown in FIG. 3B, when a 3.1 microsecond pulse interval is used, the total difference in spot placement is reduced to only 0.30 mil. Such curves may similarly be calculated for other values of r, $v_c$ and $v_d$. In fact, FIG. 3B is also a very good approximation to a case of a drop velocity $v_d$ of 10 m per second with a platen radius r of 0.717 inch and a carriage velocity $v_c$ of 10 inches per second.

It can be shown that the best that the constant time interval compensation can achieve is a total difference in drop placement of $\frac{1}{4}$ of an uncompensated misplacement. The optimal length of the constant time interval t is $(n/N)(h^2/2rv_d)$ where the printhead has a total of N nozzles and they are fired n at a time (the remaining variables h, r and $V_d$ being defined below). In this case, the firing time intervals are given by $\Delta t=(h^2/2rv_d)(1-y/h)$, where h is half the printhead length and y is the distance of each nozzle from the center of the printhead. In this case, $X=X_t+X_z=(v_c/2rv_d)(h^2-hy+y^2)$. The extreme is found (by differentiating with respect to y) to occur at $y=h/2$ and has a value of $3\ v_c\ h^2/8rv_d$, which is $\frac{3}{4}$ of X at $y=0$ and $y=h$. In Examples 1 and 2, the difference in spot placement was a little more than $\frac{1}{4}$ of the uncompensated case because of cumulative errors in rounded off time intervals, as well as timing errors from firing pairs of nozzles rather than a truly sequential firing.

An even better compensation for the curved platen can be made if the pulse intervals are distributed approximately quadratically. The goal is to make the total displacement constant, that is, $X=X_z+X_t=v_c[(y^2/2rv_d)+t_m]=K$, where $t_m$ is the time when the $m^{th}$ element is fired. K is solved for by setting $t_m=0$ corresponding to a time, to for the end jets where $y=h$. This yields $t_m=(h^2-y^2)/2rv_d$. One problem in trying to distribute the time intervals quadratically is that firing pulses would overlap near the center of the printhead. For the printhead and printer parameters of Example 1, a quadratic distribution of time intervals requires that the time between firing adjacent pairs near the center of the printhead is 0.3 microseconds. Since the pulse width is assumed to be 3 microseconds, this would lead to considerable overlap. This could lead to problems such as too much peak current for the drivers or leads.

EXAMPLE 3

Figure 3C:
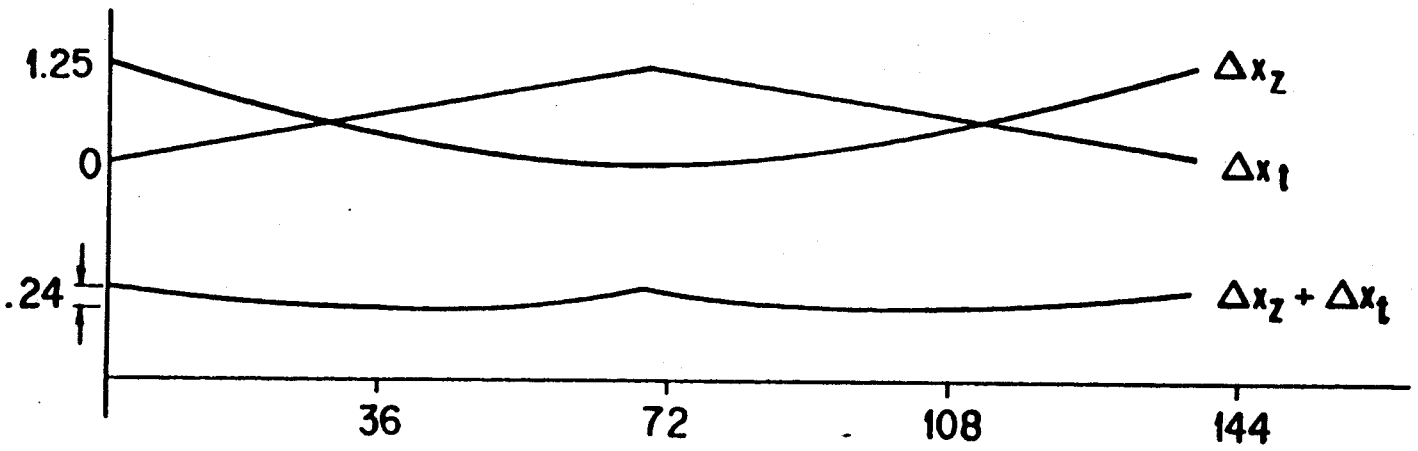
FIG. 3C is a graph illustrating spot placement versus nozzle position on the printhead achieved according to a third embodiment of the present invention.

An alternative solution is to minimize the actuating time intervals at the center of the printhead (with no overlap) and to widen the intervals near the end of the printhead. Example 3 assumes the same parameters as Example 1 and actuates four jets at a time beginning at the ends and working in toward the center. Rather than using a constant 3.5 microsecond time interval however, it is assumed that the time interval is 4 microseconds for the first half and 3 microseconds for the second half of the group of time intervals. As shown in FIG. 3C, the total difference in spot placement is 0.24 mil.

Figure 4A:
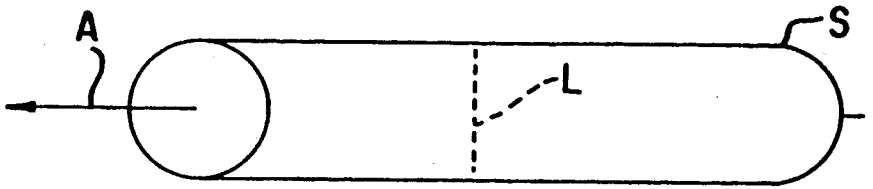
FIG. 4A is an enlarged side view of a curved surface of a platen illustrating a line of nozzles.
Figure 4B:
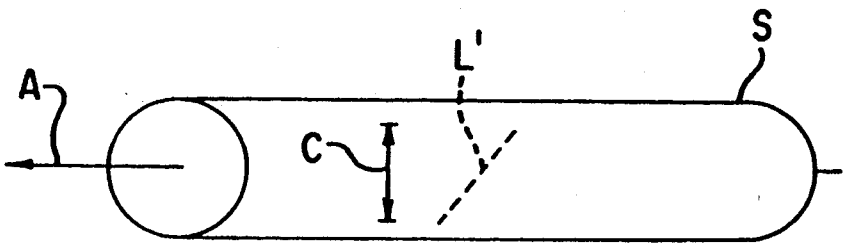
FIG. 4B is an enlarged side view of a curved surface of a platen illustrating a line of nozzles in another embodiment of the invention.

The invention has been described with reference to a line L of nozzles substantially perpendicular to the longitudinal axis A of the curved surface S of the platen, as illustrated in FIG. 4A. However the nozzles may be in a line L' that is tilted relative to the axis A of the curved surface S of the platen, the line having a projection or chord C which is perpendicular to the longitudinal axis A, as illustrated in FIG. 4B. Hence, the invention is applicable to a line of nozzles having a projection which is substantially perpendicular to the longitudinal axis of the curved surface.

Further, the invention has been described in terms of sequentially actuating the nozzles, starting with the nozzles located furthest from the platen and proceeding to actuate nozzles located progressively inwardly or closer to the platen center. The invention, however, is applicable to situations in which the jets of FIG. 2 are actuated, for example, in the following order: J1, J3, J2, J5, J4, J6, J7, J8, J10, J9, J11 etc. Thus the claimed invention is intended to encompass the actuation of nozzles located substantially progressively closer to the platen or substantially inwardly.

Although specific examples are disclosed, the present invention is applicable to any method and apparatus for printing using thermal ink jet printers having curved platens. Accordingly, the preferred embodiments of the invention as set forth herein are intended to be illustrative, not limiting. Various changes may be made without departing from the spirit and scope of the invention as defined in the following claims.

What is claimed is:

1. A method of actuating an ink jet printhead to form characters on a recording medium contained on a curved surface, said printhead including a plurality of nozzles arranged in at least one line having opposing ends and being capable of emitting ink drops at a velocity, a distance between said ends defining a printhead length, a projection of said line being substantially perpendicular to a longitudinal axis of the curved surface, said method comprising the steps of:

sequentially actuating the nozzles, starting with nozzles located furthest from said surface and proceeding to actuate nozzles located substantially progressively closer to the surface until nozzles located closest to the surface are actuated whereby the actuation of all nozzles has been performed; wherein said sequential actuation includes actuating said nozzles at successive intervals, a length of each of said successive intervals being at least as long as a pulse width of an actuation signal applied to said nozzles so that successively actuated nozzles are not actuated at the same time.

2. The method of claim 1, wherein the printhead is located relative to the surface such that a central portion of the line of nozzles is closest to the surface, said sequential actuation starting with nozzles located on each end of said line of nozzles and proceeding substantially inwardly until the actuation of all nozzles has been performed.

3. A method of actuating an ink jet printhead to form characters on a recording medium contained on a curved surface, said printhead including a plurality of nozzles arranged in at least one line having opposing ends, a projection of said line being substantially perpendicular to a longitudinal axis of the curved surface, said method comprising the steps of:

sequentially actuating the nozzles, starting with nozzles located furthest from said surface and proceeding to actuate nozzles located substantially progressively closer to the surface until the actuation of all nozzles has been performed, wherein the printhead is located relative to the surface such that a central portion of the line of nozzles is closest to the surface, said sequential actuation starting with nozzles located on each end of said line of nozzles and proceeding substantially inwardly until the actuation of all nozzles has been performed, and said nozzles are addressed four at a time, one pair of nozzles from each end of the line of nozzles being actuated simultaneously.

4. A method of actuating an ink jet printhead to form characters on a recording medium contained on a curved surface, said printhead including a center and a plurality of nozzles arranged transverse said center in at least one line having opposing ends and being capable of emitting ink drops at a velocity, a distance between said ends defining a printhead length, a projection of said line being substantially perpendicular to a longitudinal axis of the curved surface, said method comprising the steps of:

sequentially actuating the nozzles, starting with nozzles located furthest from said surface and proceeding to actuate nozzles located substantially progressively closer to the surface until the actuation of all nozzles has been performed, wherein the printhead is located relative to the surface such that a central portion of the line of nozzles is closest to the surface, said sequential actuation starting with nozzles located on each end of said line of nozzles and proceeding substantially inwardly until the actuation of all nozzles has been performed, wherein a constant time, t, between each successive actuation of nozzles is determined approximately by the formula:

$$t=(n/N)(h^2 2rv_d)$$

where h = half the printhead length;

r = radius of the curved surface;

$v_d$ = the velocity of the ink drops emitted from the nozzles;

n = number of nozzles fired at one time; and

N = total number of nozzles in the line of nozzles.

5. The method of claim 4, wherein a delay time $\Delta t$ before actuation of a nozzle in the line of nozzles is determined by the formula $$\Delta t=(h^2/2rv_d)(1-y/h)$$

where h = half the printhead length;

r = a radius of the curved surface;

$v_d$ = the velocity of the ink drops emitted by said nozzles; and y = distance of the nozzle above or below the printhead center.

6. A method of actuating an ink jet printhead to form characters on a recording medium contained on a curved surface, said printhead including a center and a plurality of nozzles arranged transverse said center in at least one line having opposing ends and being capable of emitting ink drops at a velocity, a distance between said ends defining a printhead length, a projection of said line being substantially perpendicular to a longitudinal axis of the curved surface, said method comprising the steps of:

sequentially actuating the nozzles, starting with nozzles located furthest from said surface and proceeding to actuate nozzles located substantially progressively closer to the surface until the actuation of all nozzles has been performed, wherein the printhead is located relative to the surface such that a central portion of the line of nozzles is closest to the surface, said sequential actuation starting with nozzles located on each end of said line of nozzles and proceeding substantially inwardly until the actuation of all nozzles has been performed, wherein a time, $t_m$, at which each nozzle is actuated is determined by the formula:

$$t_m[tm]=(h^2-y^2)/2rv_d$$

where $t_m$ = the time when an mth nozzle is actuated with the time when the nozzles located on each end of said line of nozzles are actuated corresponding to a time, $t_o$;

h = half the printhead length;

y = distance above or below the printhead center;

r = radius of the curved surface; and $v_d$ = the velocity of the drops emitted from the nozzles.

7. The method of claim 2, wherein the nozzles located furthest from said surface are actuated at greater intervals than the nozzles located closest to said surface.

8. An ink jet printer which compensates for systematic variation in distances between printhead nozzles and a receiving medium comprising:

a curved surface;

a printhead including a plurality of nozzles arranged in at least one line having opposing ends and being capable of emitting ink drops at a velocity, a distance between said ends defining a printhead length, a projection of said line being substantially perpendicular to a longitudinal axis of the curved surface, and means for sequentially actuating said nozzles, starting with nozzles located furthest from said curved surface and proceeding to actuate nozzles located substantially progressively closer to the surface until actuation of all nozzles has been performed; wherein said means for sequentially actuating actuates said nozzles at successive intervals, a length of each of said successive intervals being at least as long as a pulse width of an actuation signal applied to said nozzles so that successively actuated nozzles are not actuated at the same time.

9. The ink jet printer of claim 8, wherein said printhead is relative to the curved surface such that a central portion of the line of nozzles is closest to the surface, whereby nozzles located closest to said surface are innermost nozzles and the nozzles located furthest from said surface are outermost nozzles and said means for sequentially actuating said nozzles starts with nozzles located on each end of said line of nozzles and proceeds substantially inwardly until the actuation of all nozzles has been performed.

10. An ink jet printer which compensates for systematic variation in distances between printhead nozzles and a receiving medium comprising:

a curved surface;

a printhead including a plurality of nozzles arranged in at least one line having opposing ends, a projection of said line being substantially perpendicular to a longitudinal axis of the curved surface, and means for sequentially actuating said nozzles, starting with nozzles located furthest from said curved surface and proceeding to actuate nozzles located substantially progressively closer to the surface until actuation of all nozzles has been performed, wherein said printhead is located relative to the curved surface such that a central portion of the line of nozzles is closest to the surface and said means for sequentially actuating said nozzles starts with nozzles located on each end of said line of nozzles and proceeds substantially inwardly until the actuation of all nozzles has been performed, and said means for sequentially actuating addresses said nozzles four at a time, one pair of nozzles from each end of the line of nozzles being actuated simultaneously.

11. An ink jet printer which compensates for systematic variation in distances between printhead nozzles and a receiving medium comprising:

a curved surface;

a printhead including a center and a plurality of nozzles arranged transverse said center in at least one line having opposing ends and being capable of emitting ink drops at a velocity, a distance between said ends defining a printhead length, a projection of said line being substantially perpendicular to a longitudinal axis of the curved surface, and means for sequentially actuating said nozzles, starting with nozzles located furthest from said curved surface and proceeding to actuate nozzles located substantially progressively closer to the surface until actuation of all nozzles has been performed, wherein said printhead is located relative to the curved surface such that a central portion of the line of nozzles is closest to the surface and said means for sequentially actuating the nozzles starts with nozzles located on each end of said line of nozzles and proceeds substantially inwardly until the actuation of all nozzles has been performed, and a constant time interval, t, between each successive actuation of nozzles is determined approximately by the formula;

$$t=(n/N)(h^2/wrv_d)$$

where h=half the printhead length;

r=radius of the curved surface;

$v_d$=the velocity of the ink drops emitted from the nozzles;

n=number of nozzles fired at one time; and

N=total number of nozzles in the line of nozzles.

12. The ink jet printer of claim 11, wherein a delay time Δt before actuation of a nozzle in the line of nozzles is determined by the formula $$\Delta t=(h^{2b}/^{2}rv_d)(1-y/h)$$

where h=half the printhead length;

r=radius of the curved surface;

$v_d$=the velocity of the ink drops emitted from the nozzles; and y=distance of the nozzle above or below the printhead center.

13. An ink jet printer which compensates for systematic variation in distances between printhead nozzles and a receiving medium comprising:

a curved surface;

a printhead including a center and a plurality of nozzles arranged transverse said center in at least one line having opposing ends and being capable of emitting ink drops at a velocity, a distance between said ends defining a printhead length, a projection of said line being substantially perpendicular to a longitudinal axis of the curved surface, and means for sequentially actuating said nozzles, starting with nozzles located furthest from said curved surface and proceeding to actuate nozzles located substantially progressively closer to the surface until actuation of all nozzles has been performed, wherein said printhead is located relative to the curved surface such that a central portion of the line of nozzles is closest to a time, the surface and said means for sequentially actuating the nozzles starts with nozzles located on each end of said line of nozzles and proceeds substantially inwardly until the actuation of all nozzles has been performed, and said means for actuating actuates said nozzles at a time, $t_m$, according to the formula:

$$[tm=(h^2-y^2)/2rv_d]t_m=(h^2-y^2)/2rv_d$$

where $t_m$=the time when an mth nozzle is actuated with the time when the nozzles located on each end of said line of nozzles are actuated corresponding to a time, $t_o$;

h=half the printhead length;

y=distance above or below the printhead center;

r=radius of the curved surface; and $v_d$=the velocity of the drops emitted from the nozzles.

14. The ink jet printer of claim 9, wherein said means for actuating actuates the outermost nozzles at greater intervals than the innermost nozzles.

15. The method of claim 7, wherein the length of the intervals between actuation of said closest nozzles is substantially equal to said pulse width, and the length of the intervals between actuation of said furthest nozzles is greater than said pulse width.

16. The ink jet printer of claim 14, wherein said means for actuating actuates said innermost nozzles at intervals which are substantially equal to said pulse width, and actuates said outermost nozzles at intervals which are greater than said pulse width.

* * * * *